US005113773A

United States Patent [19]

Klundt

[11] Patent Number: 5,113,773

[45] Date of Patent: May 19, 1992

[54] TOP FEEDING DEVICE FOR SEWING MACHINES

[75] Inventor: Kurt Klundt, Hirschhorn, Fed. Rep. of Germany

[73] Assignee: G.M. Pfaff, Kaiserslautern, Fed. Rep. of Germany

[21] Appl. No.: 445,617

[22] PCT Filed: May 13, 1988

[86] PCT No.: PCT/EP88/00415

§ 371 Date: Mar. 14, 1990

§ 102(e) Date: Mar. 14, 1990

[87] PCT Pub. No.: WO89/01068

PCT Pub. Date: Feb. 9, 1989

[30] Foreign Application Priority Data

Jul. 27, 1987 [DE] Fed. Rep. of Germany ..... 3724788

[51] Int. Cl.[5] ..... D05B 27/04

[52] U.S. Cl. ..... 112/320

[58] Field of Search ..... 112/27, 47, 60, 80.32, 112/82, 220, 237, 238, 239, 240, 303, 312, 313, 315, 319, 320, 448, 459

[56] References Cited

U.S. PATENT DOCUMENTS

| | | | |
|---|---|---|---|
| 3,570,426 | 3/1971 | Kunes | 112/320 |
| 3,570,427 | 3/1971 | Wenz | 112/320 |
| 3,935,826 | 2/1976 | Nicolay | 112/320 |
| 4,422,398 | 12/1983 | Dusch | 112/320 |
| 4,487,145 | 12/1984 | Vollmar | 112/320 |
| 4,611,548 | 9/1986 | Holl | 112/320 X |
| 4,616,586 | 10/1986 | Scholl | 112/320 |
| 4,686,917 | 8/1987 | Braun | 112/320 X |
| 4,848,254 | 7/1989 | Krowatchek et al. | 112/320 X |
| 4,936,235 | 6/1990 | Klundt | 112/320 |

*Primary Examiner*—Werner H. Schroeder
*Assistant Examiner*—Ismael Izaguirre
*Attorney, Agent, or Firm*—McGlew & Tuttle

[57] ABSTRACT

A material top feeding device for sewing machines includes an arrangement to reduce the movement component of the top feed foot during its phase of touch-down. For this purpose, the connecting rod drive mechanism includes of a pair of connecting rods, whose connecting joint is fastened rotatably on a rocker arm mounted on the support element. The mounting of the rocker arm is arranged so that in the area of touch-down of the top feed foot, the rocker arm extends essentially in parallel to the connecting rod arranged between it and the top feed foot.

6 Claims, 3 Drawing Sheets

TOP FEEDING DEVICE FOR SEWING MACHINES

BACKGROUND OF THE INVENTION

Field of the Invention

This invention relates, in general, to sewing machines and, in particular, to a new and useful sewing machine having a lifting and feeding mechanism which includes an arrangement for insuring that the relative velocity of the top feed foot reduces substantially during its movement toward its touch-down on the material which is being sewn.

In a prior art top feeding device of this class (U.S. Pat. No. 3,570,427), a transmitting rocker arm for the lifting drive of the top feed foot is mounted on a support element of the support system in order for the top feed foot to be carried along in the upward direction during the lifting of the support system.

In this device, the lifting drive has an essentially sinusoidal movement pattern. As a result of this, the top feed foot reaches its maximum velocity upon touching down on the fabric to be sewn, so that vibrations may occur at high sewing machine speeds.

The present invention provides a movement pattern of the top feed foot in the top feeding device, so that the relative velocity of the top feed foot will reduce substantially during the touch down phase.

This task is achieved in an top feeding device for sewing machines which includes a sewing machine main drive shaft connected to a connecting rod mechanism for moving a transmitting rocker arm to achieve a lowering and lifting movement of a top feed foot and a material presser foot on a support of the sewing machine wherein a spring is provided biasing the presser foot downwardly. The movement is provided such that the feed foot touches down on the material to be sewn and feeds the material to a reciprocating swinging needle in order to have both the feed drive and the lifting drive moving the top feed foot so that its velocity decreases during is touch-down on the material. A drive mechanism is provided between the transmitting rocker arm and the presser foot. The rocker arm is provided with a common pivot. The drive mechanism includes a pair of first and second connecting rods mounted on the support and connected to the common pivot of the rocker arm.

The vertical component of movement acting on the top feed foot during its touch-down phase is reduced substantially by the device according to the present invention compared with the normally sinusoidal movement pattern, while the vertical movement component is increased outside the touch-down phase. The duration of the touch-down phase of the top feed foot is thus increased and the forces to be absorbed by the compression springs are reduced.

Even though devices for retarding the touch-down and lift-off movements of the top feed foot in top feeding devices of another basic design are known, e.g., from U.S. Pat. No. 3,935,825, these devices are of a very complicated design compared with the invention and they also require the basic design of the top feeding device to be different.

Accordingly, an object of the invention is to provide an improved transmission mechanism for insuring that the top feed foot of the feeding device is moved with a decreasing velocity as it approaches the touch-down on the material.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
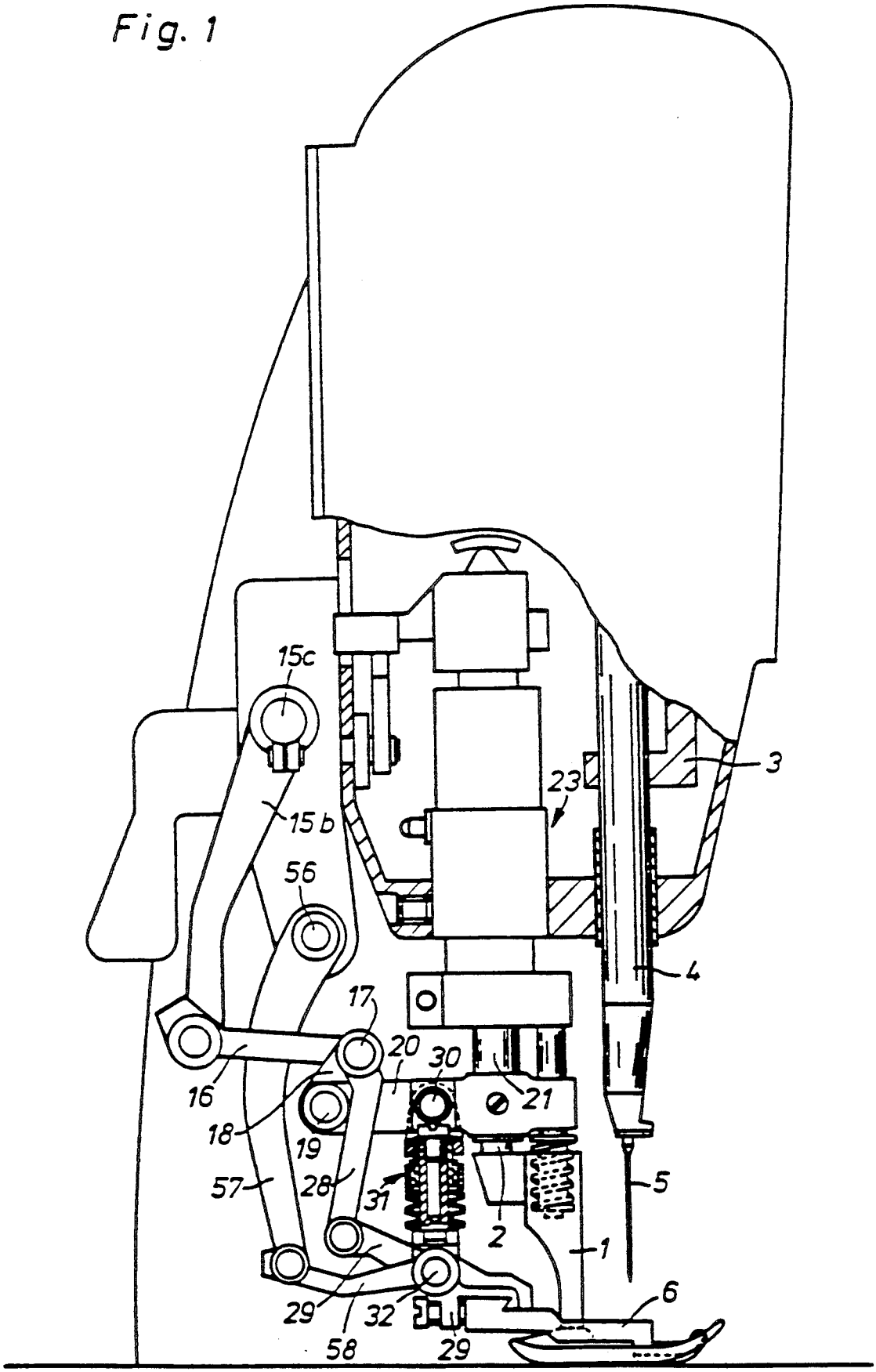
FIG. 1 is a partially cut-away side view of a sewing machine having a top feed device constructed in accordance with the invention.

Referring to the drawings in particular, the invention comprises a sewing machine, whose housing accommodates a presser bar 2 carrying a presser foot 1 and a needle bar 4 mounted in a needle bar holder 3, where the thread-guiding needle 5 of the needle bar cooperates with a shuttle (not shown). To feed the layers of fabric to be joined together, the sewing machine has a top feed foot 6, which cooperates with a lower feed dog (not shown).

Figure 2:
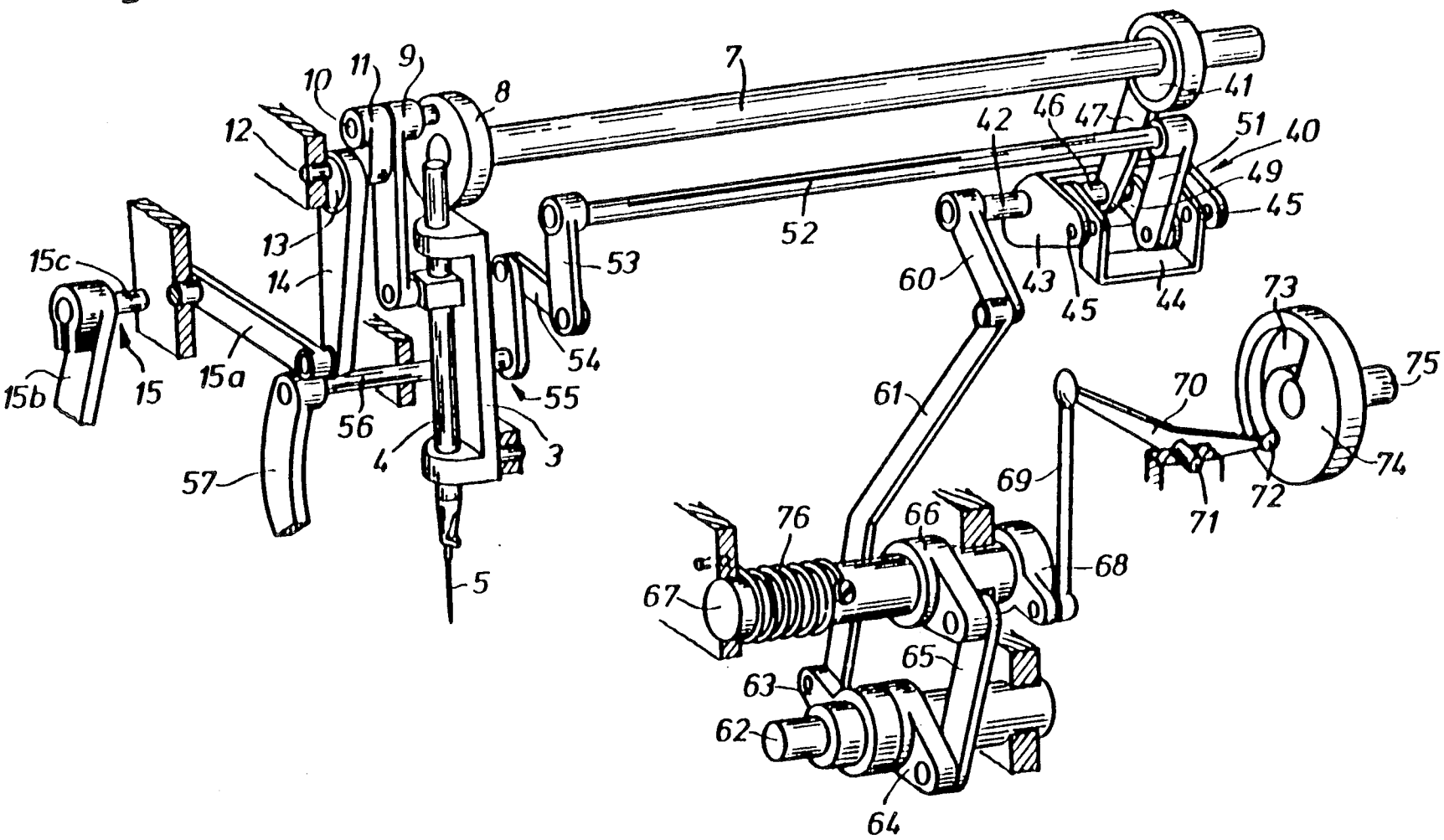
FIG. 2 is a schematic perspective representation of the driving part for the top feeding device.

The housing of the sewing machine also accommodates a main shaft 7 (FIG. 2) driven in a known manner, which drives the needle bar 4 via a crank 8 and a connecting rod 9. The connecting rod 9 is mounted on a pin 10 fastened in the crank 8.

An intermediate member 11 is also arranged on the pin 10, and the intermediate member is connected to a pin 12, which is mounted rotatably in the housing in parallel to the main shaft 7 and is fastened on an eccentric 13. The eccentric is embraced by an eccentric rod 14, which is connected to an angle lever 15, which consists of two lever arms **15*a*, 15*b* which are fastened to a shaft 15*c* mounted in a projection of the housing. The lever arm 15*b* of the angle lever 15 (FIG. 1) is connected via a first lift connecting rod 16 to a common connecting point or pin 17, which is carried by a rocker arm 18. The rocker arm 18 is mounted on a pin 19, which is fastened to a support element 20. The support element 20 is fastened to a rod 21, which is part of a support system 23. This system 23 is fastened in the housing of the sewing machine and carries, next to the vertically movable rod 21, the likewise vertically movable presser bar 2. A more detailed description of the function of the support system 23, including its connection to the two rods 2 and 21**, is contained in Patent Application PCT EP 88/00414.

Figure 3:
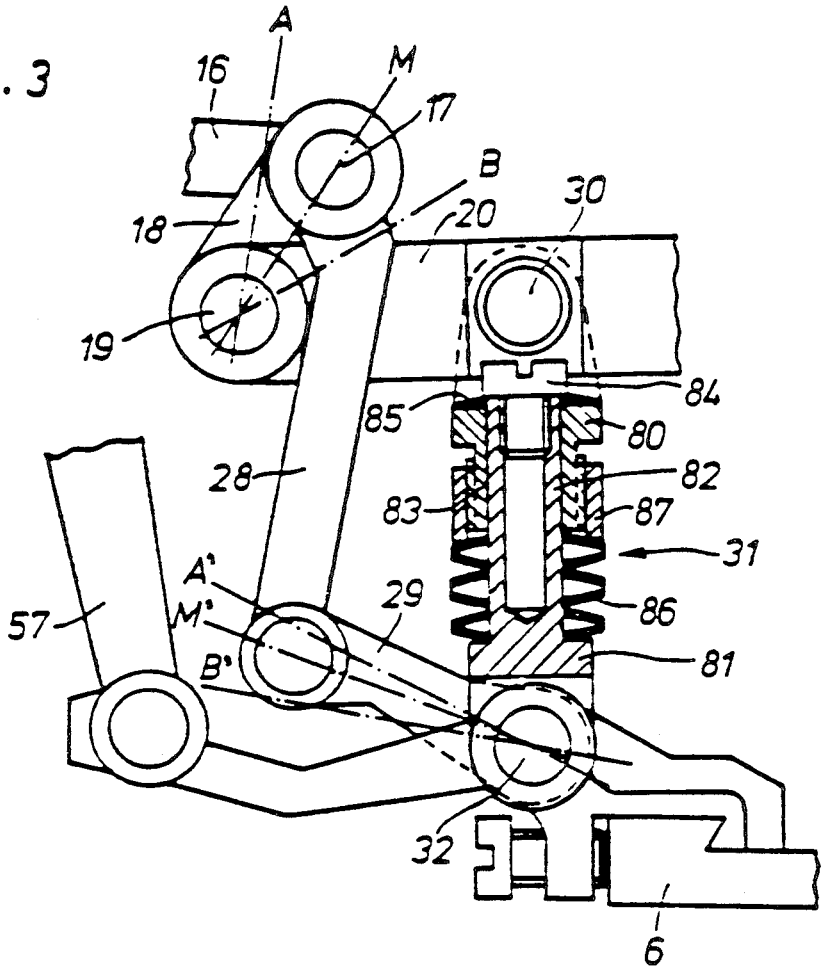
FIG. 3 is a partially cut-away representation of the transmitting elements for the top feed foot shown on a larger scale.

A second lift connecting rod 28 (FIG. 1) is mounted rotatably on a pin 17, and the other end of the second lift connecting rod 28 is hinged to a holder 29 for the top feed foot 6. The support element 20 also carries a pin 30, on which a telescopic bar 31, which is also connected to the holder 29 via a pivot pin 32, is mounted (FIGS. 1 and 3).

The top feed foot 6 is driven to perform its feeding movement by a stitch length control mechanism 40 (FIG. 2), which is connected to an eccentric 41 fastened on the main shaft 7. The stitch length control mechanism 40 has a control shaft 42 that is mounted in the housing shaft and is rigidly connected to a bracket 43, between the arms of which another bracket 44 is mounted rotatably via a pin 45. The arms of the bracket 44 are connected by a bolt 46, to which an eccentric rod 47 is hinged. The eccentric 41, which is embraced by the eccentric rod 47, forces the bolt 46 to perform swiveling movements about the pin 45.

One end of a connecting rod 49 acts on the bolt 46, and its other end is hinged to a lever arm 51, which is fastened at one end of a rocking shaft 52 mounted in parallel to the main shaft 7 in the housing. A lever arm 53 is connected to the other end of the rocking shaft 52 and the lever arm 53 acts on a rocking lever 55 via a connecting rod 54. The rocking lever 55 is fastened on a rocking shaft 56 mounted in the projection of the housing (FIG. 1), and the rocking shaft 56 carries another rocking lever 57, which is connected to the pin 32 of the holder 29 via a connecting rod 58.

A lever arm 60, which is connected to a crank 63 fastened to a control shaft 62 via a connecting rod 61, is fastened on the control arm 42 (FIG. 2) of the stitch length control mechanism 40.

A control crank 64 is clamped on the control shaft 62 mounted in the housing and is connected to an intermediate shaft 67 mounted in the housing via an intermediate member 65 and another control crank 66. A lever 68 is fastened to the intermediate shaft 67. The lever 68 is connected via a ball-headed drawbar 69 to one end of a rocking lever 70, which can be pivoted about an axis 71 forming an integral part of the housing. The still free end of the rocking lever 70 has a spherical projection 72 and reaches into a control cam 73 of a setting wheel 74 that can be locked and is arranged on an axis 75 rigidly integrated in the housing. The control cam 73 in the setting wheel 74 extends in a spiral pattern toward the axis 75 of the wheel, so that stitch lengths of, e.g., 1 to 6 mm can be selected on the top feed foot 6. A spring 76 embracing the intermediate shaft 67 and fastened with one of its ends in the housing keeps the projection 72 of the rocking lever 70 steadily in contact with one of the side walls of the control cam 73.

The control shaft 62 is connected to the lower feed dog (not shown) in the known manner, so that when the position of the setting wheel 74 is changed, both the top feed foot 6 and the lower feed dog are adjusted synchronously.

Figure 4:
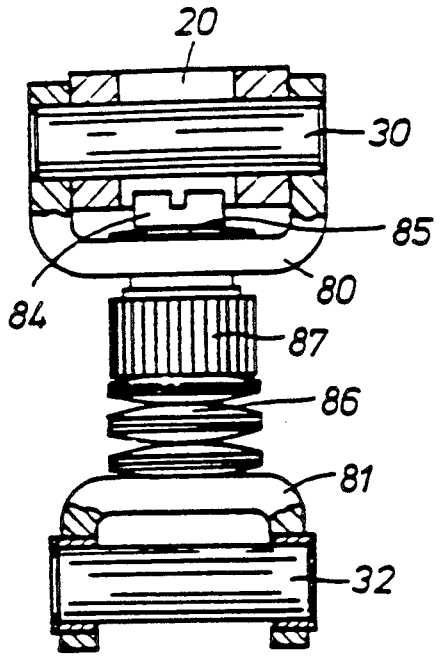
FIG. 4 shows a partially cut-away side view of the parts shown in FIG. 3.

The telescopic bar 31 arranged between the support element 20 (FIGS. 3 and 4) and the holder 29 for the top feed foot 6 is subdivided into an upper fork 80 and a lower fork 81. The lower fork 81 is connected to a bolt section 82 and the upper fork 80 is connected to a sleeve section 83, which are pushed into one another and held together by a screw 84 screwed into the bolt section 82. A plate spring 85 is inserted between the head of the screw 84 and the upper fork 80, and the spring plate assembly 86 is inserted between the sleeve section 83 and the lower fork 81. The pretension of the plate spring assembly 86 can be changed by means of a nut 87 screwed on the threaded sleeve section 83.

The device operates as follows:

The amount of feed of the top feed foot 6 (FIGS. 1 and 2) is set by rotating the setting wheel 74, as a result of which the control cam 73 will rotate the intermediate shaft 67 correspondingly via the rocking lever 70.

The intermediate shaft 67 now adjusts the control shaft 62 via the intermediate member 65 and the control shaft 42 via the connecting rod 61 and the lever arm 60. It is achieved through this arrangement that when the setting wheel 74 is adjusted, the feed setting of the top feed foot 6 is changed synchronously with the feed setting of the lower feed dog via the control shaft 62.

The movement derived from the eccentric 41 is transmitted via the drive mechanism consisting of eccentric rod 47, bolt 46, connecting rod 49, lever arm 51, rocking shaft 52, lever arm 53, connecting rod 54, rocking levers 55 and 57, connecting rod 58, pivot pin 32, and holder 29 to the top feed foot 6, which will therefore perform a corresponding feeding movement.

Synchronously with the feeding movement of the top feed foot 6, the movement, which is derived from the eccentric 13 is transmitted as a lifting movement to the holder 29 and consequently to the top feed foot 6 via the drive mechanism comprising the eccentric rod 14, the angle lever 15, the first lift connecting rod 16, the pin or common pivot 17, and the second lift connecting rod 28. Consequently, the top feed foot moves up and down in the correct cadence of its feeding movement.

When the angle lever 15 and the first lift connecting rod 16 swivel out (see FIG. 3), the rocker arm 18 is moving between the positions (A, B) in a working zone that is selected so that the up and down movement at the bolt 17 is transmitted relatively slowly in the area of position (A), but relatively rapidly in the area of position (B). The lifting movement transmitted by the first lift connecting rod 16 to the holder 29 is decelerated by the rocker arm 18 in the area between the positions (M' and A') and accelerated in the area between the positions (M' and B'). Correspondingly, the top feed foot 6 is moving slowly in the area of touch-down on the fabric to be sewn, but rapidly in the lift-off area, so that chatter effects during the touch-down on the fabric to be sewn are avoided practically completely.

The telescopic bar 31 becomes shorter during the operation while the spring tension of the spring plate assembly 86 increases, and it recovers its original length on release. Thus, after touch-down of the top feed foot 6 on the fabric to be sewn, the spring plate assembly 86 absorbs both the residual lift of the top feed foot 6 and the lifting movement of the lower feed dog via the needle plate.

While a specific embodiment of the invention has been shown and described in detail to illustrate the application of the principles of the invention, it will be understood that the invention may be embodied otherwise without departing from such principles.

I claim:

1. Sewing machine with an upper feeding device, comprising:

a support system;

an upper feed foot pivotally connected to said support system by a bar;

a lifting drive mechanism; and a connecting rod arrangement connected between the lifting drive mechanism and said upper feed foot, said connecting rod arrangement having a lift connecting rod connecting on one end to said upper feed foot and on another end to said lifting drive mechanism, said connecting rod arrangement also having a rocker arm having a first end pivotable on said support system and a second end connected in a hinged manner to said connection between said lift connecting rod and said lift drive mechanism for forming with a direction of a lifting movement of said upper feed foot an angle having a minimum in an area of a touch-down position of said upper feed foot and thus slowing said feed foot as said feed foot approaches touch-down position.

2. Sewing machine in accordance with claim 1, wherein:

said bar is a bilaterally spring-tensioned telescopic bar, connected to said support system and to said upper feed foot, positioned substantially parallel to said connecting rod arrangement.

3. A material feeding device for sewing machines comprising:

a drive mechanism including a feed drive and a lifting drive having respective feed and lifting connecting rods;

a presser foot connected to said drive mechanism;

a support system including a spring biasing said pressure foot into engagement with the material to be fed;

a top feed foot connected to said drive mechanism and to said support system, a common pivot;

a first lift connecting rod connected on one end to said feed drive and on another end to said common pivot;

a second lift connecting rod connected on one end to said top feed foot and on another end to said common pivot;

a rocker arm pivotably mounted on one end to said support system and on another end to said common pivot, said rocker arm extending substantially parallel to said second lift connecting rod when said top feed foot is in a position close to touch-down of the material.

4. A material top feeding device according to claim 3, further comprising:

a telescopic bar connected between said support system and said top feed foot in a substantially parallel position to said second lift connecting rod.

5. Sewing machine with an upper feeding device, comprising:

a support system;

an upper feed foot pivotally connected to said support system by a bar and movable in a feeding direction;

a drive mechanism; and a connecting rod means arranged between said drive mechanism and said upper feed foot for moving said upper feed foot between a touch-down position and a lift-off position, said connecting rod means having a lift connecting rod connected on one end to said upper feed foot and on another end to said lift drive mechanism, said connecting rod means also having a rocker arm having a first end pivotable on said support system and a second end connected in a hinged manner to said connection between said lift connecting rod and said lift drive mechanism slowing said movement of said feed foot when said feed foot is approaching said touch-down position, and increasing said movement of said feed foot when said feed foot is approaching said lift-off position.

6. Sewing machine with an upper feeding device, comprising:

a support system;

an upper feed foot connected to said support system;

a drive mechanism;

a connecting rod arrangement connected between the drive mechanism and said feed foot, said connecting rod arrangement also having a rocker arm pivotable on said support system and forming with a direction of a lifting movement of said upper feed foot an angle having a minimum in an area of a touch-down position of said upper feed foot and thus slowing said feed foot as said feed foot approaches touch-down position; and a bilaterally spring-tensioned telescopic bar, connected to said support system and to said upper feed foot, positioned substantially parallel to said connecting rod arrangement.

* * * * *